US005520031A

United States Patent [19]

Davidge

[11] Patent Number: 5,520,031

[45] Date of Patent: May 28, 1996

[54] ADHESIVELY MOUNTED SECURITY SYSTEM

[75] Inventor: Gregory M. Davidge, Kula, Hi.

[73] Assignee: Tortoise Products, Inc., Kula, Hi.

[21] Appl. No.: 419,855

[22] Filed: Apr. 11, 1995

Related U.S. Application Data

[63] Continuation of Ser. No. 277,088, Jul. 19, 1994, abandoned, which is a continuation of Ser. No. 972,166, Nov. 5, 1992, Pat. No. 5,349,834, which is a continuation-in-part of Ser. No. 852,576, Mar. 17, 1992, abandoned.

[51] Int. Cl.[6] ..... E05B 73/00

[52] U.S. Cl. ..... 70/18; 24/304; 70/49; 70/58; 70/234; 156/306.6; 156/311; 224/315; 248/205.3; 248/499; 248/505; 403/268

[58] Field of Search ..... 70/18, 30, 49, 70/54–56, 57, 58, 233–235, 229; 403/265, 268; 292/302; 156/306.6, 311; 24/304, DIG. 11; 224/315, 901, 42.25, 42.4; 248/499, 505, 503, 205.3, 205.4, 683; 411/82, 258

[56] References Cited

U.S. PATENT DOCUMENTS

| | | | |
|---|---|---|---|
| 276,164 | 4/1883 | Donahue | 24/DIG. 11 X |
| 2,210,455 | 8/1940 | Hosking | 411/187 |
| 3,316,338 | 4/1967 | Rieke | 411/258 X |
| 3,632,071 | 1/1972 | Cameron | 248/205.3 X |
| 3,765,197 | 10/1973 | Foote | 70/55 X |
| 3,821,975 | 7/1974 | Haker | 70/229 X |
| 3,899,904 | 8/1975 | Brimhall, II | 70/58 |
| 3,942,646 | 3/1976 | Nelson et al. | 211/5 |
| 4,055,284 | 10/1977 | Bott | 224/42.4 X |
| 4,352,614 | 10/1982 | Hirsch | 411/402 X |
| 4,657,460 | 4/1987 | Bien | 411/258 |
| 4,723,866 | 2/1988 | McCauley | 411/402 X |
| 4,822,656 | 4/1989 | Hutter, III | 248/205.3 X |
| 4,830,558 | 5/1989 | Sweeney | 411/258 |
| 4,831,849 | 5/1989 | Kortenbrede | 70/54 X |
| 5,050,836 | 9/1991 | Makous | 70/58 X |
| 5,051,049 | 9/1991 | Wills | 411/258 |
| 5,065,603 | 11/1991 | Kloke | 70/30 X |
| 5,349,834 | 9/1994 | Davidge | 70/58 X |

*Primary Examiner*—Lloyd A. Gall
*Attorney, Agent, or Firm*—Laff, Whitesel, Conte & Saret

[57] ABSTRACT

A security device is described that is simple and reliable. It includes a base member which is adhesively attached to the surface of a large object such as a motor vehicle. A protective knife-edged boss surrounds and protects the adhesive to defeat attempts to pry the base member off the vehicle. Housed within the base member is a steel tube, and a locking cable extends through the tube to secure personal property. A cavity is provided for easy installation of the tube within the base member, and a flange is attached to the tube for preventing extraction of the tube from the base member, as well as defeating removal of the base member from the vehicle. A three-way system of adhesion is employed which provides superior results.

2 Claims, 4 Drawing Sheets

ADHESIVELY MOUNTED SECURITY SYSTEM

This application is a continuation of application Ser. No. 08/277,088, filed Jul. 19, 1994 (now abandoned), which in turn is a continuation of application Ser. No. 07/972,166, filed Nov. 5, 1992 (now U.S. Pat. No. 5,349,834), which in turn is a continuation-in-part of application Ser. No. 07/892,576, filed Mar. 17, 1992 (now abandoned).

FIELD OF INVENTION

This invention relates to security devices. More particularly, it relates to security devices that can be permanently mounted to the surface of a non-portable object, such as a motor vehicle.

BACKGROUND OF INVENTION

Personal items which are large but portable, such as bicycles, skis, and the like, are commonly transported from place to place in or on vehicles such as automobiles or pick-up trucks. Typically, such articles are carried in the trunk or on the roof or rear deck of an automobile, or in the open bed of a pick-up truck. Various security devices have previously been used for securing such items against theft, but these have all been cumbersome or unreliable, especially under extreme temperatures. None has provided a simple yet effective means of securing personal property to an automobile or truck to prevent its unauthorized removal. Rack-mounted security devices, for example, can be complicated to use and are often easily circumvented through the use of ordinary hand tools. In addition, security devices which are mounted to the exterior of a vehicle often fail to expand and contract thermally at the same rate as the vehicle's surface, resulting in degradation of the coupling between the vehicle surface and the security device.

Accordingly, it is one of the objects of this invention to provide a simple yet reliable means for removably securing personal property to a large object so as to prevent theft of such property.

A more particular object is to provide a sturdy, tamper-proof means for securing portable items to a vehicle.

A further object of this invention is to provide a reliable means for securing personal property that is useable under the temperature extremes normally encountered out-of-doors.

Another object is to provide a device of this nature which is difficult to defeat; in particular one in which a steel tube prevents removal of the security cable which is associated therewith, and from which the steel tube itself is nearly impossible to remove when the device is in use.

It is also an object to provide such a device in a configuration which is simple and therefore economical to manufacture; in particular one in which the steel tube may be inserted after molding of the main body of the device.

These and other objects, features and advantages of the invention will become apparent from the following description.

SUMMARY OF THE INVENTION

A security device in accordance with the present invention is provided for the purpose of removably attaching a portable article to the surface of a non-portable object (such as a motor vehicle) so as to prevent the unauthorized removal of the portable article. In its broadest form this device comprises a base member and fastening means for permanently attaching the base member to a surface of the non-portable object. The base member has a substantially cylindrical opening, and a metal reinforcing tube is concentrically fitted within that opening. An elongated attaching member is adapted for insertion through the opening of the base member and the metal tube, and extends outwardly toward the portable article. Finally, means are provided for removably securing the attaching member to the portable article. The function of the metal tube is to prevent extraction of the attaching member from the cylindrical opening by cutting solely through the body of the base member. It would be necessary to cut through the metal tube as well.

In a preferred embodiment of the invention, the base member has a lower surface which is adhesively attached to the surface of a vehicle or other non-portable object, and a boss means projects from the lower surface of the base member to surround and thus protect the adhesive fastening means. The lower surface of the boss is preferably raked at an angle such that the outer edge thereof makes a knife-edge contact with the surface of the vehicle, thereby minimizing opportunities to insert a prying tool thereunder.

The base member is preferably molded of a plastic material, and the cylindrical opening is molded therein. A central portion of the cylindrical opening opens downwardly through the bottom surface to form an access window which permits upward insertion into the cylindrical opening of the reinforcing tube, so that the latter advantageously need not be molded into the plastic material of the base member. A limiting flange attached to the lower extremity of the reinforcing tube prevents upward removal of the tube and the attaching member from the cylindrical opening, even if someone should succeed in cutting through the body of the base member and thus exposing the tube.

BRIEF DESCRIPTION OF THE DRAWINGS

These and other features of this invention will be best understood by reference to the following detailed description of a preferred embodiment of the invention, taken in conjunction with the accompanying drawings, in which.

DETAILED DESCRIPTION OF THE INVENTION

Figure 1:
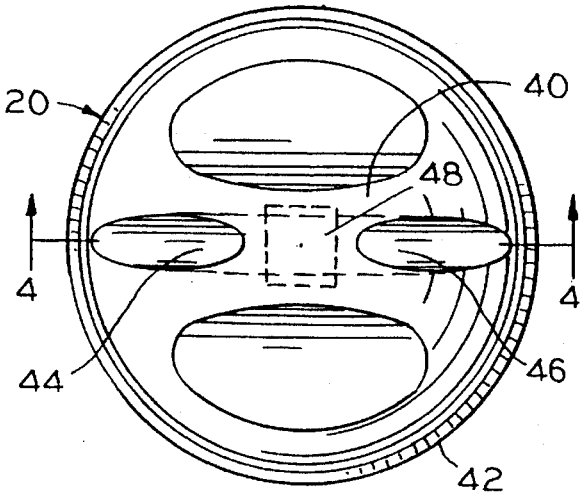
FIG. 1 is a top plan view of a security device constructed according to the present invention, shown without its security cable.
Figure 2:
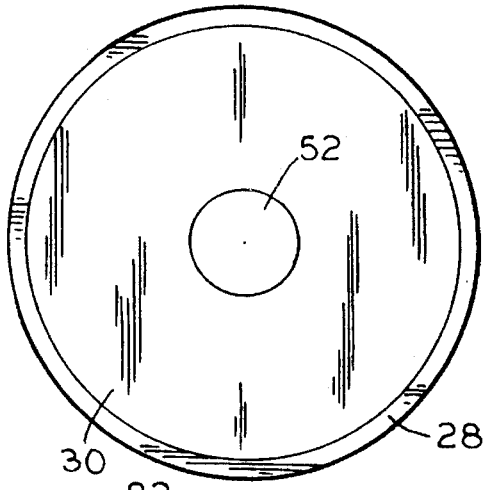
FIG. 2 is a bottom plan view of the security device of FIG. 1, shown without any bonding material or adhesive.
Figure 3:
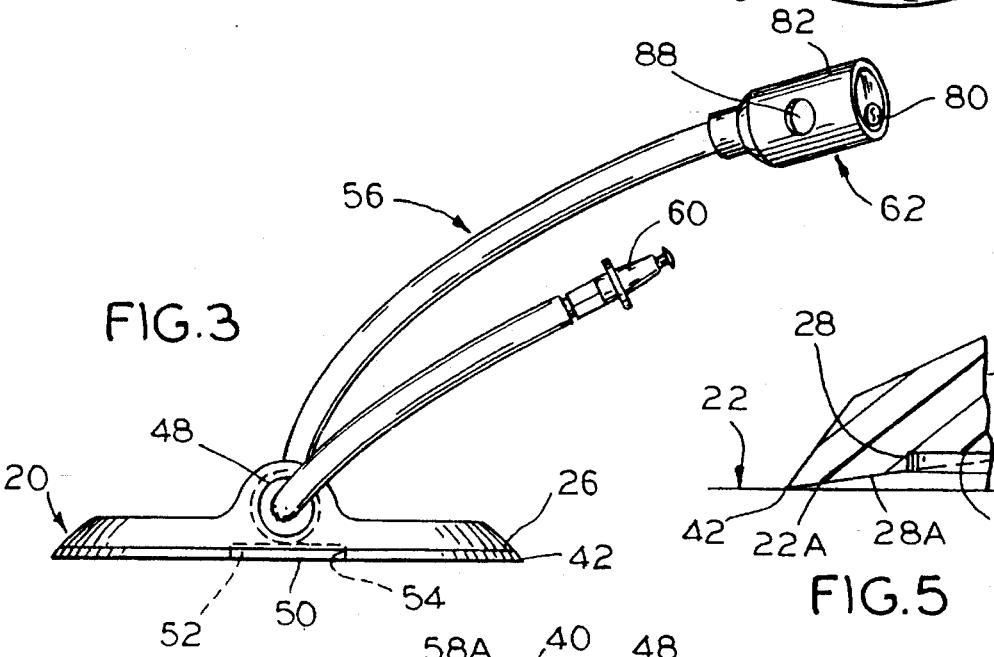
FIG. 3 is a side elevation view of the security device, shown with the security cable.

Referring now to FIGS. 1–3, there is shown a preferred embodiment of a security device 20 constructed according to the present invention. The security device 20 comprises a substantially planar base member, preferably in the form of a disk 26 molded of glass-impregnated nylon resin material and formed with a depending peripheral boss 28 that extends circumferentially about the lower surface 30 of the base member. This combination of nylon and glass is particularly strong, handles physical impact well, and is resistant to degradation by pollution, ultra-violet light and extremes of weather.

Figure 7:
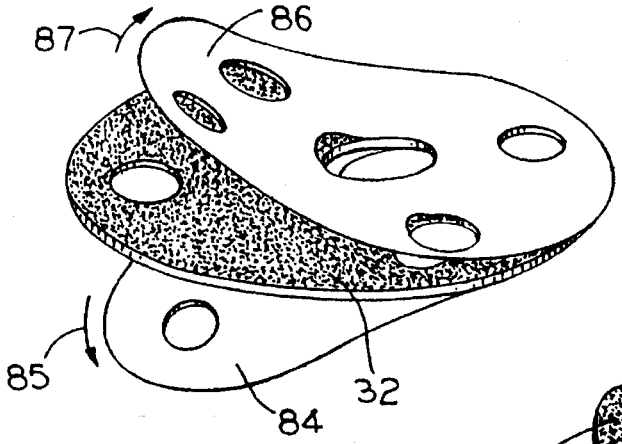
FIG. 7 is a partially exploded perspective view of the bonding material for the security device and its protective backings.
Figure 8:
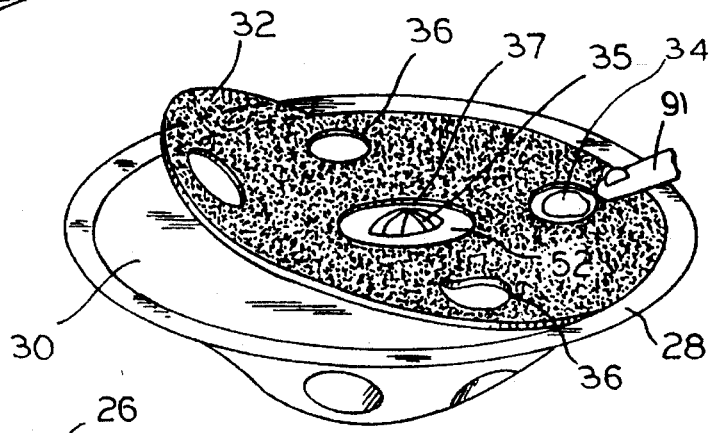
FIG. 8 is a partially exploded perspective view from the bottom of the security device, showing the bonding material in position and the application of an adhesive.
Figure 9:
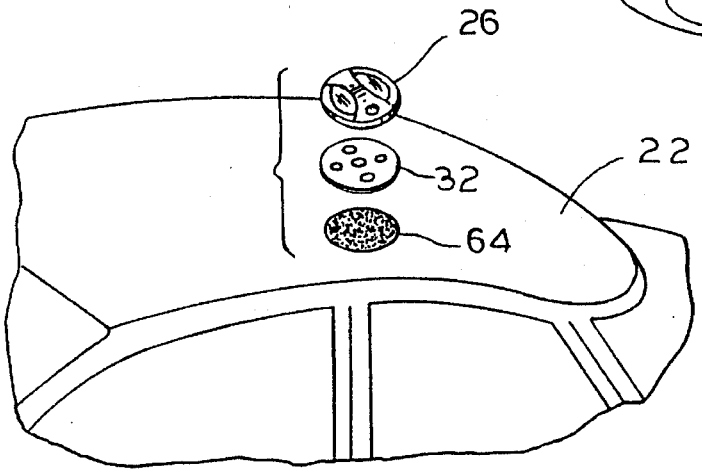
FIG. 9 is an exploded perspective view of the security device, without the security cable, attached to an automobile roof.

In one embodiment, as shown in FIGS. 7–9, the base member 26 is secured to a vehicle surface 22 with a pressure-sensitive bonding material 32, such as the 3M Company's very high bonding double-coated acrylic foam tape No. 4945, and two different adhesives 34, 35, such as the 3M Company's epoxy type No. 2216 and epoxy type No. DP 420. The base member 26 may come installed as original equipment by a vehicle manufacturer, or may be purchased in the after-market and installed by an end user.

Figure 11:
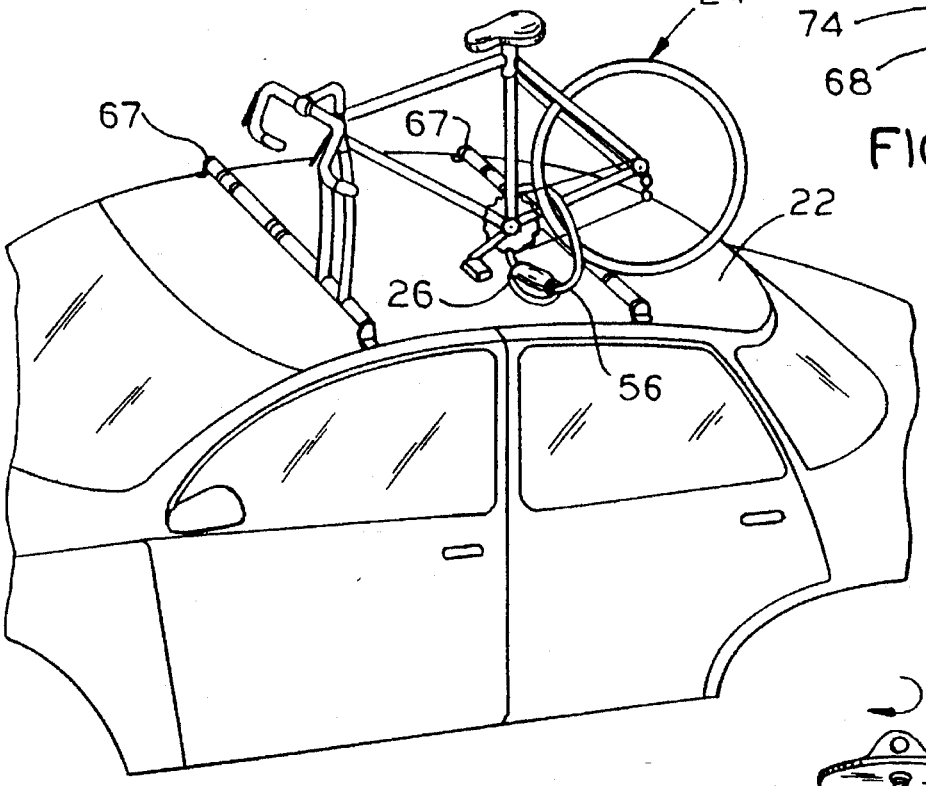
FIG. 11 is a perspective view of the vehicle and security device of FIG. 10, shown with a bicycle mounted on the rack and secured to the vehicle.

As shown in FIGS. 1 and 3, the upper surface of the base member 26 is formed with a raised arch 40 which extends diametrically across the disk of the base member. A substantially cylindrical tunnel 44, 46 extends longitudinally through the arch 40, i.e. in a direction parallel to a diameter of the disk-shaped base member 26, and is continuous from one face of the arch to the diametrically opposite face thereof. Tightly received within the tunnel, between branches 44 and 46 thereof, is a case-hardened steel reinforcing tube 48 having an axial bore 50. An attachment device such as a security cable 56 is threaded through the cylindrical tunnel 44, 46 and bore 50, and is also threaded through one or more articles 24, as shown in FIG. 11, and secured by means of a conventional key-operated or combination-operated locking mechanism 62.

As seen in FIG. 3, once the security cable 56 is threaded through the tube 48, it is not possible to lift the cable out of the tunnel 44, 46 merely by cutting through the resin material of the arch 40; it is necessary also to cut through the much harder material of the steel tube 48.

The security cable 56 is a conventional wound wire rope encased in a protective plastic sheath. Wire rope construction is preferable to chain link construction for its ability to resist being severed by industrial bolt cutters.

The terminal end 60 of cable 56 couples to the locking mechanism 62 for securing personal articles to the device 20. As seen in FIG. 3, the locking mechanism 62 preferably comprises a conventional key-actuated device 80 encased in a protective plastic housing 82 attached to cable 56. The locking mechanism 62 defines an aperture 88 allowing for insertion and positive coupling with terminal cable end 60. No interlocking parts are left exposed to the outside. This locking mechanism offers simplicity of use, unity of design, and security from tampering.

Figure 10:
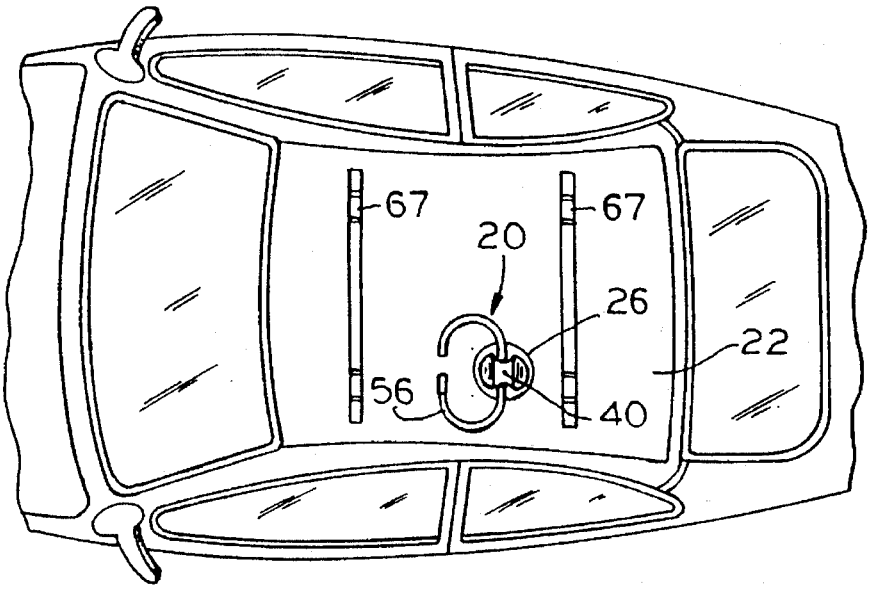
FIG. 10 is a top plan view of a vehicle with the security device, permanently attached to a surface thereof, and a bicycle rack mounted thereon.

The steel reinforcing tube 48 would be difficult to embed in the plastic mass of the base member 26 by molding in place. Such a manufacturing process would substantially increase the production cost of the security device 20. Therefore the central portion of the tunnel, between branches 44 and 46 thereof, is molded to define a cavity 58 (see FIG. 6) which opens downwardly through the bottom surface 30 of base member 26. The cavity 58 is rectangular in horizontal cross-section, and its upper surface is cylindrical (to match the shape of the exterior of the tube 48) and rises higher than the top wall of the tunnel 44, 46 by an amount equal to the thickness of the walls of tube 48. See FIG. 4. The length of the cavity 58 along the axis of the tunnel is barely larger than the axial dimension of the steel tube 48, and the horizontal diameter of the cavity 58 is barely larger than the diameter of the steel tube, so that when the tube is inserted within the cavity, with the axis of the tube co-linearly aligned with the axis of the tunnel, it is received with a firm force-fit, thus preventing the tube from falling out of the cavity and getting lost between the time that the security device 20 is assembled and the time that it is permanently mounted upon a vehicle or other non-portable object. After such mounting, at which time the lower surface 30 of the base member 26 is affixed to the vehicle or other object as illustrated in FIGS. 10 and 11, the tube 48 is permanently trapped in the cavity 58.

The tube 48 is permanently attached at its lowest point (for example, by spot welding) to a steel flange 52 that acts to limit upward insertion of the tube 48 into the cavity 58. The limiting flange 52 preferably is circular, but may also have a rectangular or other shape. The flange is received within a depression 54 formed in the central region of the lower surface 30 of base member 26, and has a diameter (or largest horizontal dimension) which exceeds the largest horizontal dimension of the tube 48 and of the cavity 58. As a result, once it is seated within that depression 54, the flange 52 limits any further upward movement of the tube 48.

At the time of assembly of the security device 20 this limiting function is somewhat superfluous, since the same function is performed by the abutment of the top surface of the tube 48 against the roof of the cavity 58. But when the security device is in use, a thief who manages to cut away the plastic material of the arch 40 above the tunnel 44, 46, in the hope of then being able to lift the tube 48 and cable 56 upwardly out of the tunnel, will be prevented from realizing that hope by the abutment of the limiting flange 52 against the roof of the depression 54.

The thickness of the flange 52 is equal to the depth of the depression 54. As a result, when the assembly of the tube 48 and flange 52 are inserted into the cavity 58 and depression 54 respectively, the bottom surface 52A of the flange 52 is flush with the bottom surface 30 of the base member 26 (see FIG. 4), thus presenting a continuous smooth surface 30, 52A for the application of adhesives. The steel flange 52 thus serves a further function by providing a metallic bonding surface for adhesives which attach the security device to the vehicle 22 or other non-portable object.

For attachment purposes, a portion 64 of the vehicle surface 22 is specially prepared for mating with bonding elements 30, 32 and 52 of device 20, as can be seen in FIG. 9. Portion 64 of surface 22, which is preferably congruent with the bottom of the base member 26, is abraded to expose the vehicle's underlying paint primer. Any conventional industrial-strength abrasive pad, such as a 3M Scotch Brite brand industrial pad, can be used for scouring the area 64. The exposed vehicle paint primer is then treated with an appropriate solvent such as acetone or trichloroethane in order to cleanse the area 64.

Next, as can be seen in FIGS. 7 and 8, a circularly shaped pressure-sensitive, adhesive-coated sheet 32, such as the 3M Company's VHB type 4945, is applied to the lower disk surface 30 within the central area surrounded by the protective boss 28. This particular 3M sheet has two different adhesives, one on each surface of sheet 32, to promote adhesion to the plastic surface of base member 26 on one side, and the metallic surface of vehicle 22 on the other side. A first protective release-paper backing 84 is removed (see arrow 85) from the side of the adhesive sheet 32 facing the lower surface 30 prior to application. The adhesive sheet 32 is formed of a foam material, resiliently compressible in the thickness dimension, and has an initial thickness slightly greater than the depth of the boss 28 to facilitate proper contact and adhesion of the device 20 to the abraded vehicle surface 64. The adhesion of sheet 32 to the bottom surface 30 and the vehicle surface 64 provides the first of three different bonding relationships between the base member 26 and the vehicle 22.

As shown in FIG. 8, the adhesive sheet 32 has a plurality of openings 36 that are used to accommodate application of a second adhesive material 34 such as 3M Company's epoxy adhesive type 2216, which is specially formulated to promote bonding directly between the lower disk surface 30 and the metallic vehicle surface 64. This particular 3M epoxy remains pliable to the degree necessary to accommodate expansion and contraction of the metal vehicle surface so that the bond will not be broken or weakened by temperature fluctuations. The second adhesive 34 is loaded into the plurality of openings 36 by means of a flat instrument 91. The openings 36 allow for more precise measurement and placement of the second adhesive 34, and thus minimize any wandering or waste of the adhesive during its application to the lower surface 30 of base member 26.

But even more importantly, the openings 36 serve to expose the plastic material of the base member 26 at selected locations on its lower surface 30, so that it can be affixed directly to the vehicle surface 64 at those locations, without the sheet 32 interposed therebetween. The use of adhesive 34 in the locations defined by openings 36 creates the second of three types of bonding relationships between the base member 26 and the surface of vehicle surface 22. This second type of bond serves to reinforce and diversify the previously described bond created by adhesive sheet 32.

A third adhesive material 35 is applied in a similar manner (or by using a mixing applicator, such as the 3M Company's EPX brand applicator system) to a centrally located opening 37 of sheet 32. Opening 37 exposes the lower surface 52A of limiting flange 52 to permit yet a third bonding relationship, that between the metallic limiting flange surface 52A and the metallic vehicle surface 64, for permanently attaching the security device 20 thereto. As a result, even if a thief were to succeed in detaching the base member 26 from the vehicle 22 or in removing enough of the plastic material of the base member 26 to expose the upper surfaces of both the tube 48 and the flange 52, in order to free the cable 56 from the vehicle 22 it would still be necessary either to dislodge the flange 52 from its adhesive attachment to the vehicle surface 64 or to cut away the top of the steel reinforcing tube 48.

A special adhesive, such as the 3M Company's Scotch-Weld brand epoxy type DP 420, is used as the material 35 to bond the lower surface 52A of the steel limiting flange 52 to the metallic vehicle surface 64. This metal bond has strength characteristics somewhat similar to a weld, and (so long as the combination of the steel tube 48 and limiting flange 56 remains mechanically coupled to the base member 26) this third adhesive bond reinforces the previously described bonds created by adhesive material 34 and adhesive sheet 32.

As can be seen in FIGS. 7 and 8, a second protective release-paper backing 86 on the remaining exposed surface of the bonding material 32 is then removed in anticipation of placement on the prepared vehicle surface 64. The lower surface 30 of the base member 26, with its adhesive spots 34, the lower flange surface 52A with its adhesive material 35, and the now-exposed lower adhesive surface of the sheet 32 are positioned over the abraded vehicle surface 64 as seen in FIG. 9. Hand pressure is then applied to the top of the base member 26 to form a permanent bond between the lower surface 30, the adhesive material 34, the pressure-sensitive adhesive sheet 32, the limiting flange surface 52A, the adhesive material 35, and the abraded vehicle surface 64.

This method of permanent attachment has the distinct advantage that the resilient foam sheet 32 and the adhesive materials 34, 35 allow for differential thermal expansion and contraction between the plastic base member 26 and the metallic surface of vehicle 22 as the temperature fluctuates, thereby preventing any separation between the base member 26 and the vehicle surface 64.

Figure 5:
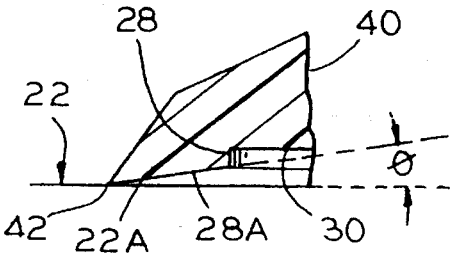
FIG. 5 is an enlargement of a portion of the cross-section view of FIG. 4, showing details of the base member boss edge.
Figure 4:
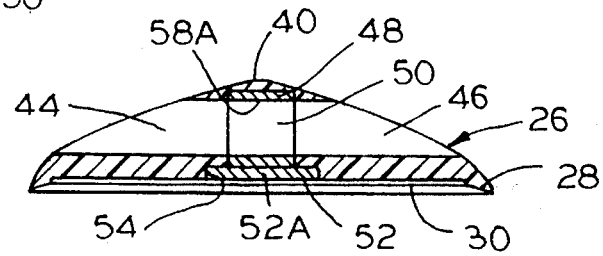
FIG. 4 is a cross-section view of the security device taken along line 4—4 of FIG. 1.
Figure 6:
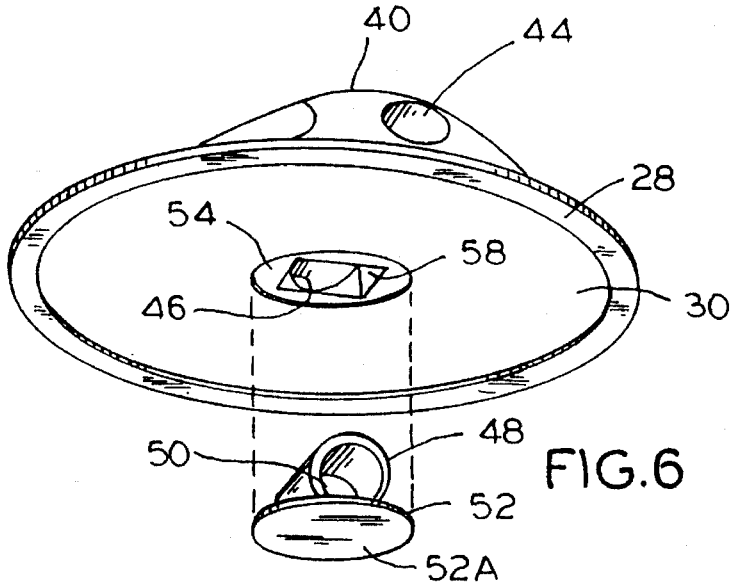
FIG. 6 is an exploded perspective view of the security device showing the relationship of the reinforcing tube to the base member.

As shown in FIGS. 4–6, a boss 28 extends downwardly from the perimeter of the lower surface 30 of base member 26. The downward extension of the boss 28 serves to surround and thus protect from tampering the bonding sheet 32 and the adhesive materials 34 and 35 which are used for permanent attachment of the lower surfaces 30, 52A to the vehicle surface 64. As shown in FIG. 5, the lower surface 28A of boss 28 is raked upwardly at an angle, preferably about 15°, so that the outer perimeter of boss 28 is its lowest extension.

This forms a linear, or knife-edge, zone of contact 42 between the lower surface of the boss 28 and the vehicle surface 64. This limited zone of contact encourages a very close fit between the base member 26 and the vehicle 22. Otherwise, any convex vehicle surface irregularities in the region 22A (FIG. 5) located just radially inward of the edge 42 would tend to elevate the entire boss 28 slightly above the general level of the surface of vehicle 22, thus permitting the insertion of a knife, wedge, or other thin object that might be used to pry the base member 26 away from its adhesive engagement with the vehicle 22. Thus the raked angle of surface 28A contributes to the overall security of device 20.

In operation, cable 56 is passed through cylindrical tunnel 44, 46 and tube 48 as shown in FIG. 21, and extends outwardly from the base member 26 toward an article such as a bicycle 24 mounted on an automobile roof rack 67, and is threaded through the bicycle frame as shown in FIG. 11. The terminal cable end 60 is then coupled to the locking mechanism 62, thus securing the article 24 to the device 20 and in turn to the vehicle 22. Any appropriate wire rope cable and locking mechanism, such as a Kryptonite-3 brand cable and lock, can be used to secure a portable object 24 in this manner.

Figure 12:
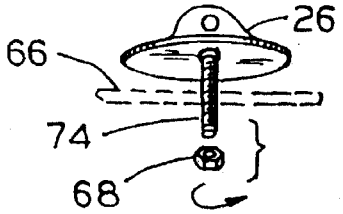
FIG. 12 is a perspective view of one form of mechanical fastener which can be used to attach the security device to a sheet metal panel.
Figure 13:
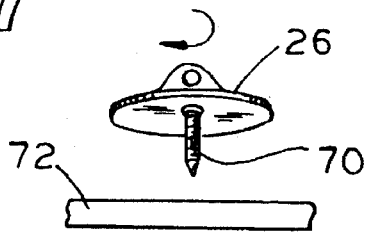
FIG. 13 is a perspective view of another form of mechanical fastener which can be used to attach the security device to a wooden beam.

Additional embodiments, shown by FIGS. 12 and 13 respectively, provide alternative methods of permanent attachment of the base member 26 to a stationary or immovable object. In FIG. 12, a mechanical fastener such as a bolt 74 is used to supplement or replace chemical adhesive fasteners. In this case, the bolt 74 is formed integrally with the flange 52, or alternatively is welded to the lower surface of the flange 52; and the lower, threaded end of the bolt extends downwardly from the flange so that the bolt 74 can extend through an opening in a metal panel 66 which is part of some large, non-portable object. A nut 68 on the other side of the panel 66 is used to fasten the bolt 74 to the panel 66 thereby, attaching the base member 26 to the large object.

Alternatively, the mechanical fastener may be in the form of a wood screw 70 as shown in FIG. 13. This embodiment is similar to that of FIG. 12, except that the fastener 70 is screwed into a wooden beam 72 which is part of some large, non-portable object so that the security device 20 is permanently attached thereto.

Figure 14:
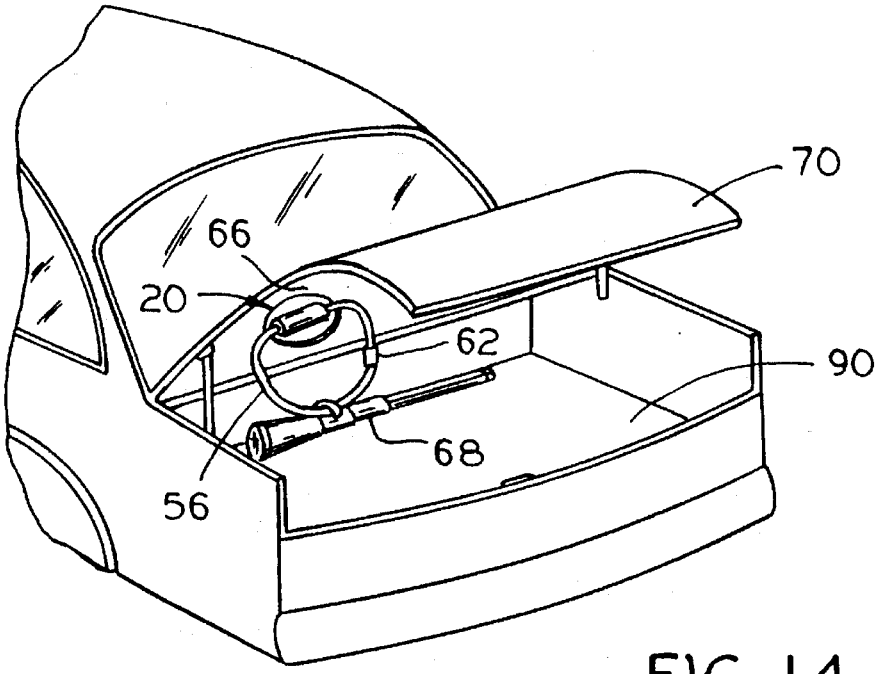
FIG. 14 is a perspective view of the security device attached to an interior trunk surface of an automobile and secured to a personal article.
Figure 15:
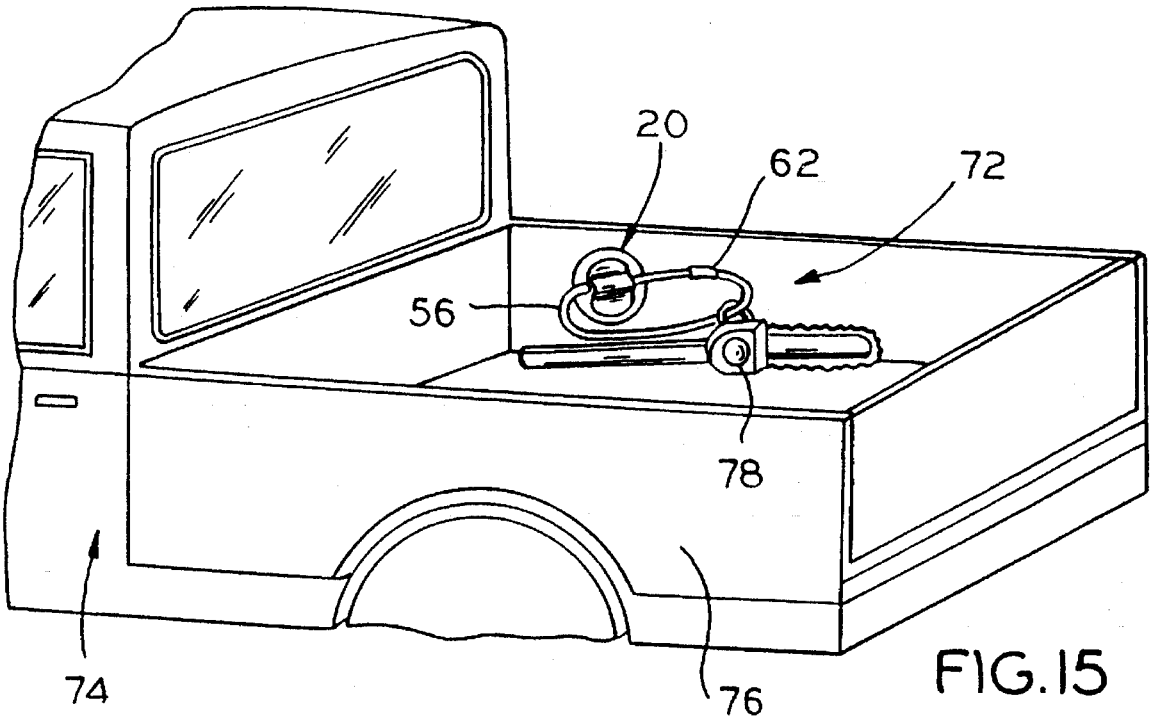
FIG. 15 is a perspective view of the security device permanently attached to an inner rear bed wall of a pick-up truck and secured to a personal article.

Other examples are shown by FIGS. 14 and 15. FIG. 14 shows the security device 20 attached to the inner surface 66 of an automobile trunk lid 70 for securing a rifle 68 within the trunk 90. The security cable 56 is threaded through the device 20, and then through the trigger guard of the rifle 68 which is stored in the trunk 90. Attachment of the ends of the security cable 56 to each other is then accomplished by means of the locking mechanism 62.

FIG. 15 shows the security device 20 attached to a pick-up truck 74. Here, the security device 20 is permanently attached to the inner surface 72 of the truck's rear load bed 76. The security cable 56 is threaded through the device 20, and then through the frame of a power saw 78. The security cable 56 is then secured by means of the locking mechanism 62.

While particular embodiments of the invention have been shown and described, it will be obvious to those skilled in the art that various changes and modifications may be made without departing from the spirit and scope of the invention. Therefore, it is intended that the appended claims will cover all such changes and modifications.

What is claimed is:

1. A security device for removably attaching a portable article to a non-portable object to prevent unauthorized removal of the portable article, comprising:

a base member having a substantial planar surface, said base member including a raised arch extending substantially diametrically of said planar surface, said arch having a tunnel extending through the arch;

means for removably securing said base member to said portable article;

means for adhesive attachment of the base member to a surface of the non-portable object;

the adhesive attachment means comprising resiliently compressible, doubly adhesive sheet means disposed between the substantially planar surface of said base member and a substantially planar surface of said non-portable object to adhesively secure them together wherein:

said base member is formed of a polymeric material;

metallic means is disposed on the substantially planar surface of said base member;

said adhesive sheet means has at least one opening therein to expose said metallic means; and additional adhesive material is disposed in said opening to adhesively secure said metallic means directly to said non-portable object.

2. A security device for removably attaching a portable article to a non-portable object to prevent unauthorized removal of the portable article, comprising:

a base member having a substantial planar surface, said base member including a raised arch extending substantially diametrically of said planar surface, said arch having a tunnel extending through the arch;

means for removably securing said base member to said portable article;

means for adhesive attachment of the base member to a surface of the non-portable object;

the adhesive attachment means comprising resiliently compressible, doubly adhesive sheet means disposed between the substantially planar surface of said base member and a substantially planar surface of said non-portable object to adhesively secure them together, wherein:

said base member is formed of a polymeric material;

metallic means is disposed on the substantially planar surface of said base member;

said adhesive sheet means has a first opening therein to expose said polymeric material at the substantially planar surface of said base member;

additional adhesive material is disposed in said first opening to adhesively secure said polymeric material at the substantially planar surface of said base member directly to said non-portable object;

said adhesive sheet means has a second opening therein to expose said metallic means; and additional adhesive material is disposed in said second opening to adhesively secure said metallic means directly to said non-portable object.

* * * * *